United States Patent [19]

Kelly

[11] Patent Number: 4,733,514

[45] Date of Patent: Mar. 29, 1988

[54] BUILDING CONSTRUCTION WITH MELTABLE INSULATION AND RESERVOIR TROUGH THEREFOR

[76] Inventor: Thomas L. Kelly, c/o Kelly Energy System, Inc., P.O. Box 2583, Waterbury, Conn. 06723

[21] Appl. No.: 849,306

[22] Filed: Apr. 8, 1986

[51] Int. Cl.[4] ..... E04B 1/94

[52] U.S. Cl. ..... 52/317; 52/232

[58] Field of Search ..... 52/317, 232, 421, 743, 52/303, 408

[56] References Cited

U.S. PATENT DOCUMENTS

| | | | |
|---|---|---|---|
| 755,171 | 3/1904 | Root | 52/405 |
| 1,428,881 | 9/1922 | Dyar | 52/317 |
| 1,433,606 | 10/1922 | Dyar | 52/317 |
| 1,786,732 | 12/1930 | Balduf | 52/405 |
| 2,625,930 | 1/1953 | Harris | 52/232 |
| 3,334,461 | 8/1967 | York | 52/317 |
| 3,786,604 | 1/1974 | Kramer | 52/232 |
| 4,449,336 | 5/1984 | Kelly | 52/232 |
| 4,455,802 | 6/1984 | Charniga | 52/317 |

FOREIGN PATENT DOCUMENTS

| | | | |
|---|---|---|---|
| 525338 | 4/1928 | Fed. Rep. of Germany | 52/421 |

*Primary Examiner*—John E. Murtagh
*Assistant Examiner*—Caroline D. Dennison
*Attorney, Agent, or Firm*—Hayes & Reinsmith

[57] ABSTRACT

A fire barrier partition having a body with a cavity for receiving and containing molten insulation is disclosed for use in building constructions. The partition is supported between building members in positively wedged engagement. The partition may support a cover which restricts the flow of oxygen into the cavity while allowing molten insulation to flow freely into the partition cavity.

14 Claims, 10 Drawing Figures

BUILDING CONSTRUCTION WITH MELTABLE INSULATION AND RESERVOIR TROUGH THEREFOR

FIELD OF THE INVENTION

This invention relates to building structures and particularly to a building construction having a reservoir installed in its interior wall and ceiling spaces for catching and containing meltable insulation in the event of fire.

BACKGROUND OF THE INVENTION

It has been known in the construction of residential and commercial buildings and other structures, such as industrial and manufacturing plants, to provide fire barriers or fire baffles between opposed wall members. These baffles conventionally have been integral wooden or metal panels or screens to prevent fires and flames spreading through the building. Kramer U.S. Pat. No. 3,786,604 discloses a pliable steel trough containing an urea formaldehyde resin foam filling an upwardly opening cavity of the trough. Wire screens, such as shown in Charniga U.S. Pat. No. 4,455,802, and metal fire baffles, such as disclosed in York U.S. Pat. No. 3,334,461, are also known. However, such fire barriers or baffles have not been heretofore effectively used in building constructions known to the inventor wherein the fire barriers or baffles also serve as insulation-melt reservoirs in the event of fire.

OBJECTS OF THE INVENTION

A primary object of this invention is to promote effective use of certain insulation materials (such as expanded and extruded polystyrene, hereinafter referred to as EPS or styrene) in residential homes and other structures such as commercial and industrial buildings. To the knowledge of the inventor, these styrene materials are not now being used because of their propensity to melt and flow when heated at relatively low temperatures. However, these styrene materials have higher thermal insulation efficiency ratings than equivalent insulation and also are more cost effective than conventional residential insulation materials.

Another object of this invention is to prevent molten insulation from flowing downwardly between building members while also providing a fire stop to limit expansion of fire, flames and drafts.

Yet another object of this invention is to provide a prefabricated trough formed and dimensioned to be readily and easily installed between building members to form an essentially fireproof and leakproof receptacle for molten insulation.

Still another object of this invention is to provide a trough formed of imperforate material featuring side walls which wedge against opposing building members to capture downwardly flowing molten insulation. Also included in this object is the aim of providing a closure of hood which restricts the flow of oxygen into a cavity of the trough while allowing free flow of molten insulation into that trough.

Another object of this invention is to provide an imperforate trough to collect flowing molten insulation which requires a minimum of structural supports or braces to hold it in place within a building structure.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

Conventional building structures containing combustible, flowable materials, such as foamed insulation, normally present both safety and fire prevention problems. The trough of this invention limits any risk associated with using such insulation materials by providing a means for catching and containing meltable insulation among building members.

More particularly, a partition or trough having a cavity for receiving and containing such molten insulation is mounted between opposed building members; the partition is positively wedged against opposing building members for catching any downwardly flowing insulation melt. Furthermore, the partition may have a hood which restricts oxygen flow into a restricted partition cavity entrance while also allowing molten insulation to freely flow into the cavity.

DETAILED DESCRIPTION OF PREFERRED EMBODIMENTS

Figure 1:
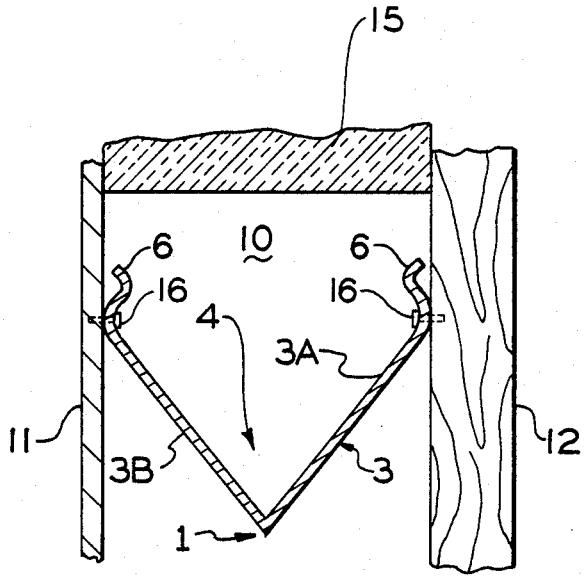
FIG. 1 is an end view, partly in section and partly broken away, showing a reservoir trough of this invention between interior and exterior wall members of a building.
Figure 2:
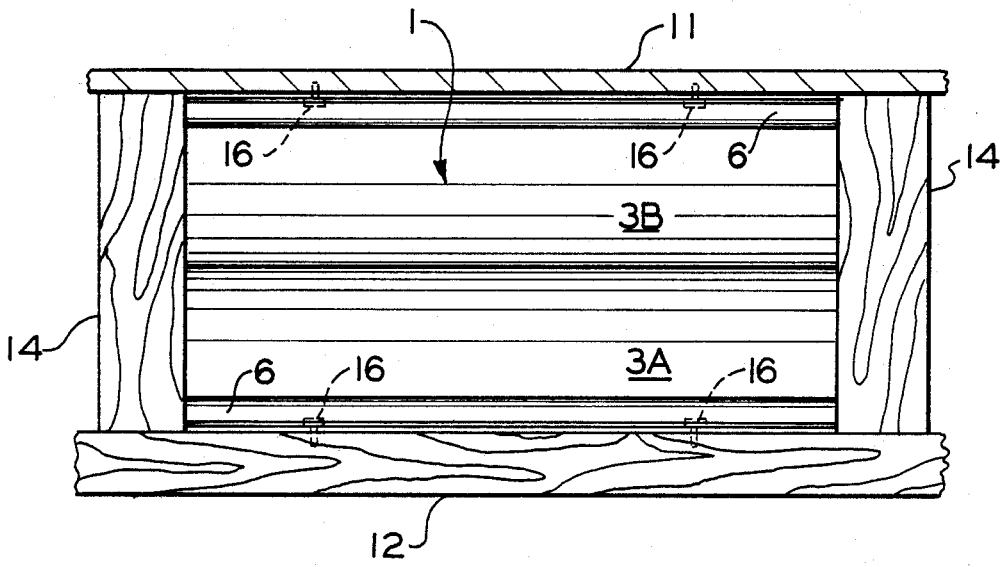
FIG. 2 is a plan view, partly broken away, of the trough of FIG. 1.
Figure 3:
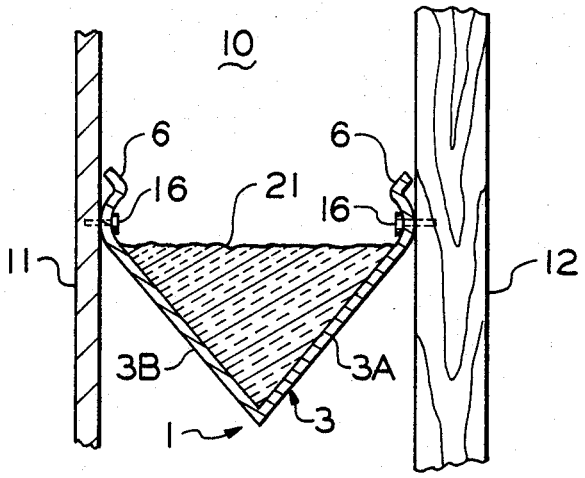
FIG. 3 is an end view, similar to FIG. 1, showing the reservoir trough of FIG. 1 filled with insulation melt.

In FIGS. 1–3, an elongated chevron-shaped partition or trough 1 is illustrated having a body 3 of appropriate width and length to serve as a reliable fire baffle and reservoir trough for catching and containing insulation melt within a building structure. While the invention of this application is primarily illustrated as being installed in interior hollow walls of a building, it is to be understood that the fire reservoir trough may be installed within ceiling spaces of a building to capture molten insulation from roofing installations and the like.

A building wall structure typically includes spaced confronting wall members, such as interior sheet rock member 11, an exterior plywood or wooden wall member 12 and spaced uprights or spaced studs 14, 14 between members 11 and 12. Studs 14, 14 cooperate with confronting wall members 11 and 12 to define an interior wall compartment 10. Meltable insulation, such as shown at 15, in any suitable form such as blocks or sheets will be understood to be received within wall compartment 10 in overlying relation to reservoir trough 1. This insulation is of a type which, as described more specifically below, becomes a flowable molten mass, or insulation melt, when subjected to heat.

As seen in FIGS. 1 and 3, the elongated partition body 3 is of generally V-shaped cross section with longitudinally extending sides 3A and 3B joined along their bottom edges to form an imperforate upwardly opening cavity 4. Body 3 may be made of fire resistant material, such as sheet metal, or any other suitable material, preferably about ½ inch in thickness. Galvanized sheet steel is suitable because of its resistance to deterioration, but other suitable metals may be substituted therefor.

For sealing portions of the interior wall compartments 10, thereby to provide reliable smoke and fire baffles to effectively resist drafts and the propagation of flames through the hollow wall compartments 10, while also forming a cavity 4 to capture insulation melt within the building structure in the event of fire, sidewalls 3A and 3B are dimensioned such that body 3 completely seals off the interior wall compartment 10. In the specifically illustrated embodiment, a contoured reversely bent shoulder 6 is shown formed integrally with an upper longitudinally extending edge of each sidewall 3A and 3B to project toward the adjacent wall member 12, 11.

A section of body sidewalls 3A, 3B (just below its respective reversely bent shoulder 6, 6) engages wall members 11, 12 and are fastened to wall members 11 and 12 (or studs 14, 14) by fasteners 16 (such as screws, nails, or any other suitable fastener) to support body 3 within wall compartment 10.

Accordingly, when any heat or fire reaches a temperature sufficient to melt the insulating material 15, the insulation melt 21 (FIG. 3) flows downwardly. With the trough or partition body 3 so disposed in FIGS. 1–3 between building members, the partition 1 functions to entrap any downward flow of molten insulation 21 within cavity 4. The placement of such partitions throughout the interior compartments formed among the building members will stop the spread of fire by retaining molten insulation in the area where the fire started.

Figure 3A:
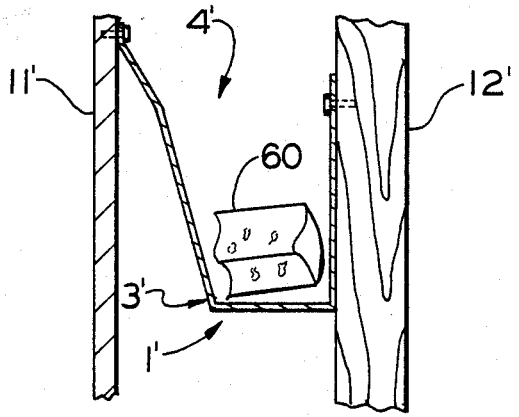
FIG. 3A is an end view, partly in section and partly broken away, of a different embodiment of the reservoir trough of this invention having a sealed pouch of liquid flame-retardant and fire extinguishing chemicals contained therein.

To be more fully effective, a plurality of partitions or troughs 1 may be provided in each individual compartment 10 and preferably staggered at different heights relative to that of the partitions in adjacent compartments to provide a means for containing substantially all of any insulation melt formed during a fire. It is to be understood that cavity 4 of trough 1 may itself be filled with insulation under normal conditions, particularly when the wall compartment 10 is filled with loose or granular insulation in contrast to the above mentioned block or sheet insulation. Moreover, as seen in FIG. 3A, a pouch of fire-retardant chemical 60 also may be placed within cavity 4' or trough 1' to inhibit combustion of molten insulation.

Figure 4:
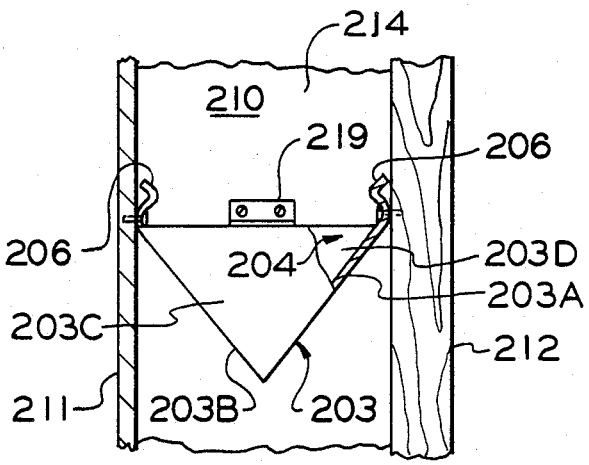
FIG. 4 is an end view, partly in section and partly broken away, illustrating another embodiment of this invention.
Figure 5:
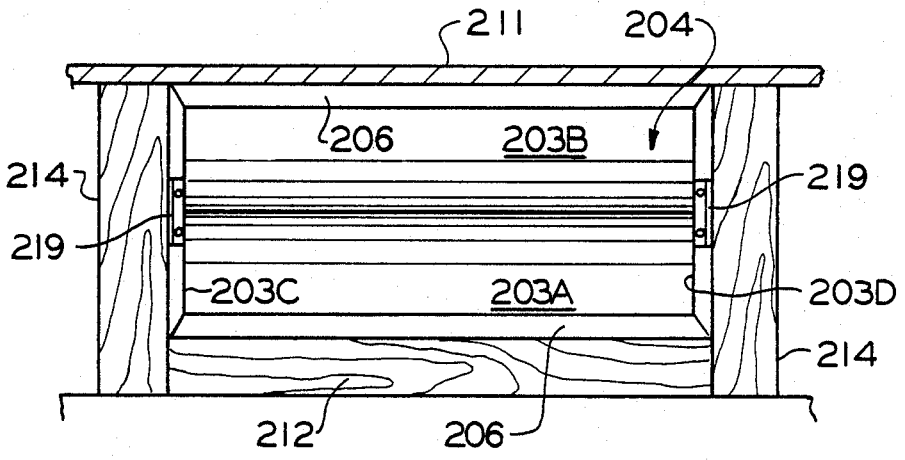
FIG. 5 is a plan view, partly broken away, of the trough of FIG. 4.

In another embodiment of the invention illustrated in FIGS. 4 and 5, partition body 203 is shown in wedged engagement with wall members 211, 212. Body 203 has opposite end walls 203C and 203D each integral with at least one of the side walls 203A and 203B to define cavity 204. Reversely turned shoulders 206, 206 are formed on sidewalls 203A, 203B to project toward wall members 212, 211; flanges 219, 219 integrally extend from end walls 203C, 203D. Sidewalls 203A, 203B and flanges 219, 219 are each suitably secured to wall members 212, 211 and studs 214, 214, respectively.

Figure 4A:
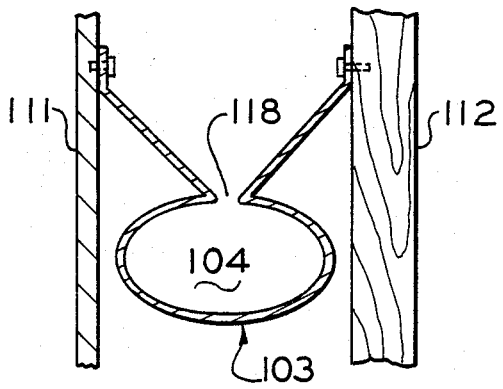
FIG. 4A is an end view, partly in section and partly broken away, showing still another embodiment of the reservoir trough of this invention having an oval cavity.

While the particular partition of "V" shaped cross-section shown in the several figures described above has been found to be both efficient and convenient in certain installations, it may be desirable to modify the shape of partition body 3 to allow more flexible use in different locations within a given building structure. The partition body may be of any suitable cross-sectional shape, e.g., U-shaped as in FIG. 3A, or annular, and still be within the spirit and scope of this invention. As illustrated in FIG. 4A, body 103 is shown mounted between building members 111, 112 and having an oval shaped cross-section and a restricted, upwardly directed opening 118 defining a constricted entrance to cavity 104 to more readily contain molten insulation and more effectively cut the oxygen supply to any burning insulation received in cavity 104. Such a cross-sectional configuration serves both to restrict the flow of oxygen into cavity 104 and also to reduce any opportunity of the volatile insulation melt within that cavity 104 to oxidize, because that volatile insulation melt does not have the same exposure to open air as it would were it in an open vessel as shown in FIG. 1.

Figure 6:
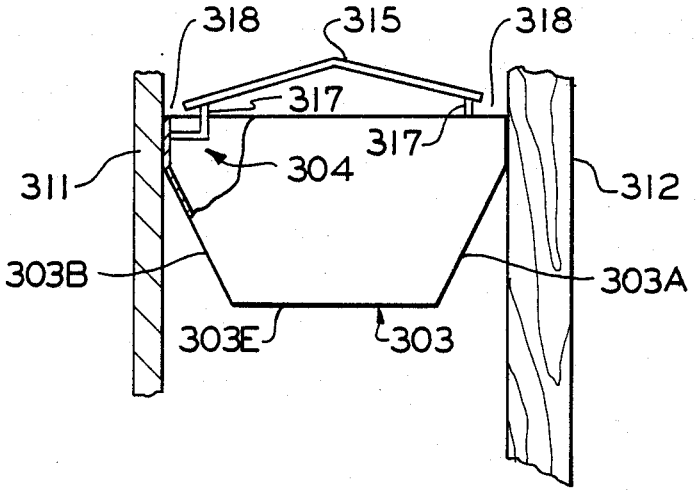
FIG. 6 is an end view, partly in section and partly broken away, showing yet another embodiment of the trough of this invention having a hood mounted on side walls of the trough.

As seen in FIG. 6, yet another embodiment of this invention is shown wherein a closure or hood 315 is suitably mounted (by brackets such as at 317) in overlying relation to partition body 303 and its interior cavity 304. Brackets 317 will be understood to be spaced apart along each side of body 303. Its internal cavity 304 is defined by a pair of sidewalls 303A, 303B extending upwardly from a flat bottom wall 303E to be secured to building members 312, 311. To permit flow of molten insulation while restricting oxygen flow into cavity 304, hood 315 overlies the opening of partition body 303 but does not entirely seal its cavity 304. Rather, hood 315 and body 303 jointly form restricted spaces or gaps 318, 318 each defining a constricted entrance opening into cavity 304 along opposite longitudinally extending side edges of body 303 to permit insulation melt to flow into cavity 304 while reducing its opportunity to oxidize as fully described above.

Figure 7:
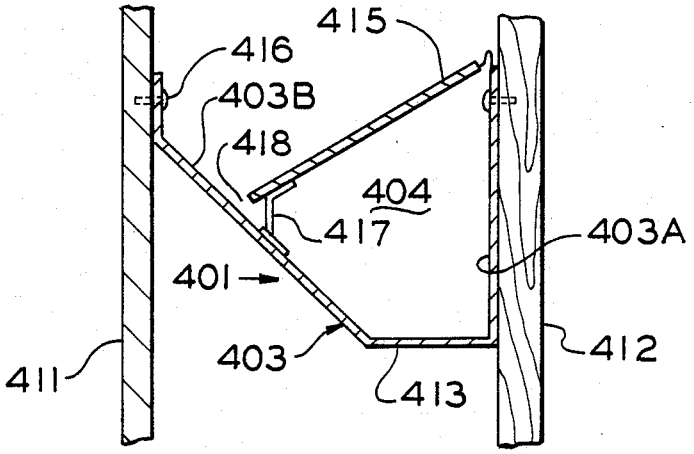
FIG. 7 is an end view, partly in section and partly broken away, of a further embodiment of a trough of this invention.

FIG. 7 illustrates a trough body 403 having one vertically extending sidewall 403A, attached flush with an interior surface of a building wall member 412, with an opposing sidewall 403B is fixed by suitable fasteners, such as at 416, to wall member 411. Sidewall 403B extends downwardly from member 411 at an angle toward wall member 412 and is interconnected to sidewall 403A by a flat base 413. A closure or hood 415 is fixed relative to sidewall 403A and supported by spaced brackets, such as the one shown at 417, on sidewall 403B, thereby to freely permit flow of insulation melt into cavity 404 while restricting oxygen flow through constricted entrance 418. This embodiment may also include end walls, not shown, integrally formed with sidewalls 403A and 403B.

Figure 8:
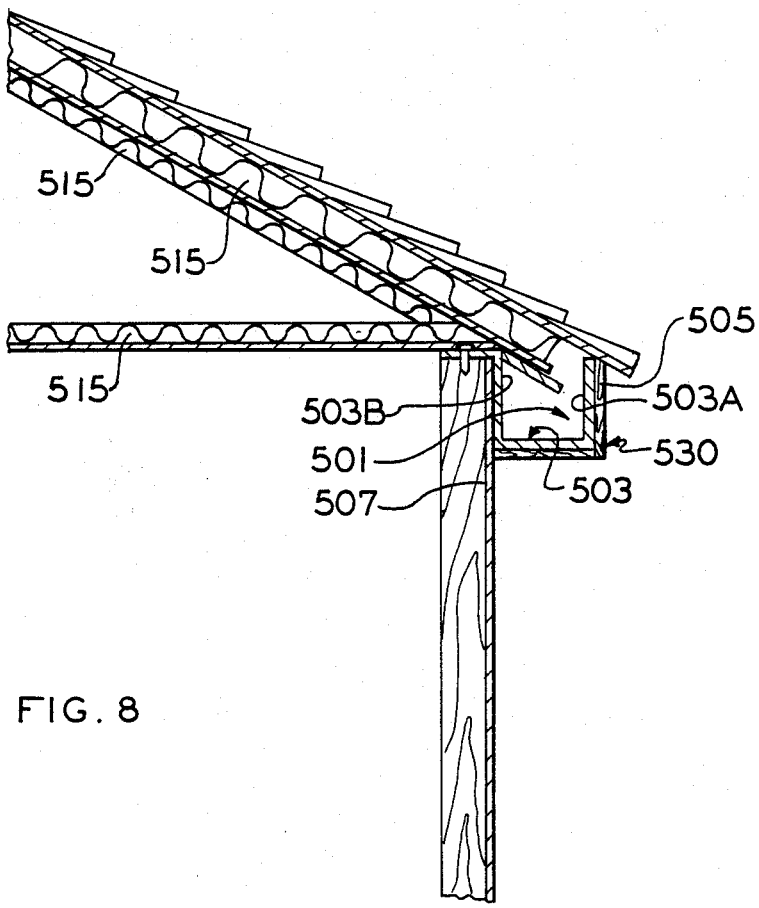
FIG. 8 is a side view, partly in section and partly broken away, of another embodiment of this invention installed within a building soffit.

FIG. 8 illustrates yet another modification of this invention wherein a partition 501 having a body 503 of U-shaped cross-section is shown mounted within a conventional roofing soffit 530. Body 503 will be understood to be elongated with opposed sidewalls 503A, 503B in adjacent relation to longitudinally extending members 505, 507 which serve as spaced confronting wall members. It is to be understood that end members, not shown, serve as spaced uprights in the disclosed roofing soffit. Body 503 accordingly extends the length of the internal compartment within soffit 530 of the building structure to provide a channel to capture any insulation melt flowing from roof insulation such as at 515 through vent openings or spacings within the roofing and building structure.

When this invention has been incorporated in a building construction, it will be understood that these partitions provide the building with substantially greater capacity for reducing the spread of a fire. This invention provides, in effect, a multiplicty of individual fire barriers for preventing the spread of flames and oxygen drafts throughout a building structure, and further prevents intensification of any fire by containing insulation melt in the cavities of the disclosed partitions. Such molten masses of insulation will flow into the cavities of the partitions and will be held therein and prevented from falling downwardly and throughout the building construction to spread or intensify a fire. Futhermore, this invention allows for the use of insulation materials such as EPS or styrene having superior insulation qualities yet significantly lower cost than conventional insulation.

As will be apparent to persons skilled in the art, various modifications, adaptations and variations of the foregoing specific disclosure can be made without departing from the teachings of this invention.

I claim:

1. A building structure comprising a pair of spaced confronting structural members, a pair of spaced uprights between the structural members and cooperating therewith to collectively define an interior compartment, a partition having a body formed of imperforate material and mounted within the interior compartment to extend generally horizontally therein and providing an imperforate sealing member for the interior compartment, the body of the partition being elongated and defining an upwardly opening cavity, and meltable insulation received within the compartment above the partition, the meltable insulation being of low heat capacity and which, when subjected to heat, undergoes a phase change transition from a solid to a flowable molten mass of decomposed combustible insulation, the cavity of the partition serving to receive and contain the flow of insulation melt in the event of fire.

2. The building structure of claim 1 wherein the cavity has a constricted entrance opening for restricting the flow of oxygen into the cavity and for reducing oxidation of any insulation melt therein in the event of fire.

3. The building structure of claim 1 further including a hood overlying the cavity, the partition body and the hood defining a gap therebetween serving as a restricted entrance opening into the cavity to permit flow of insulation melt into the cavity of the partition while restricting oxygen flow into that cavity.

4. The building structure of claim 1 wherein the meltable insulation is expanded polystyrene, extruded polystyrene or styrene.

5. The building structure of claim 1 further including fire-retardant chemicals received within the cavity of the partition.

6. The building structure of claim 1 wherein the elongated body of the partition has opposed longitudinally extending sides, the sides each including a bottom edge connected to the bottom edge of the other side to define a trough in positively wedged engagement with confronting structural members to capture insulation melt.

7. The building structure of claim 1 wherein the pair of spaced uprights and the pair of spaced confronting structural members collectively define a roofing soffit having a longitudinally extending interior compartment within which the partition is supported for receiving and containing the flow of insulation melt in the event of fire.

8. The building structure of claim 1 wherein the spaced uprights comprise upright wall studs between the structural members, and wherein the structural members comprise a pair of wall members cooperating with the studs to collectively define an interior wall compartment.

9. The building structure of claim 8 wherein the partition comprises a trough having an upwardly opening cavity, the trough having opposite longitudinally extending sides in direct engagement with the wall members for capturing any downwardly flowing insulation melt.

10. The building structure of claim 9 further including end plates extending between the longitudinally extending sides of the partition at opposite ends thereof and serving to close the partition, the end plates being supported in direct engagement with the wall studs.

11. The building structure of claim 8 wherein a first side of the partition is attached to and extends parallel to one of the wall members, a second side of the partition extends at an oblique angle from the other of the wall members toward a bottom edge of the first side of the partition, the first and second sides of the partition being interconnected to define said upwardly opening cavity.

12. The building structure of claim 8 wherein the body of the partition is of generally V-shaped cross-section.

13. The building structure of claim 8 wherein the body of the partition is of generally U-shaped cross-section.

14. The building structure of claim 8 wherein the body of the partition is of generally oval-shaped cross-section with an upwardly directed constrictive entrance opening to the cavity.

* * * * *